US006061853A

United States Patent [19]

Laaksonen et al.

[11] Patent Number: 6,061,853

[45] Date of Patent: May 16, 2000

[54] PATIENT CARRIER/RESCUE STRETCHER

[76] Inventors: Kari Laaksonen, Pato 5, FIN-23800, Laitila; Ora E. Friberg, Karisuontie 155b, FIN-45610, Koria, both of Finland

[21] Appl. No.: 09/125,853

[22] PCT Filed: Feb. 26, 1997

[86] PCT No.: PCT/FI97/00127

§ 371 Date: Apr. 26, 1999

§ 102(e) Date: Apr. 26, 1999

[87] PCT Pub. No.: WO97/30673

PCT Pub. Date: Aug. 28, 1997

[30] Foreign Application Priority Data

Feb. 26, 1996 [FI] Finland ..... 960868

[51] Int. Cl.[7] ..... A61G 1/00

[52] U.S. Cl. ..... 5/625; 5/626; 5/627; 5/628

[58] Field of Search ..... 5/625, 626, 627, 5/628, 629

[56] References Cited

U.S. PATENT DOCUMENTS

| | | | |
|---|---|---|---|
| 2,175,748 | 10/1939 | Dunn | 5/628 |
| 2,512,931 | 6/1950 | Glover | 5/625 |
| 3,135,972 | 6/1964 | Jakes et al. | 5/627 |
| 4,347,635 | 9/1982 | Eisenhauser . | |
| 4,466,145 | 8/1984 | Jones et al. | 5/628 X |
| 4,473,912 | 10/1984 | Scheidel et al. . | |
| 4,584,729 | 4/1986 | Roberts et al. . | |
| 4,736,474 | 4/1988 | Moran et al. | 5/628 X |
| 5,018,226 | 5/1991 | Davies et al. . | |
| 5,189,746 | 3/1993 | Horie . | |
| 5,201,089 | 4/1993 | Ferreira | 5/628 X |
| 5,263,213 | 11/1993 | Robertson et al. . | |
| 5,274,864 | 1/1994 | Morgan . | |
| 5,511,259 | 4/1996 | Tarara | 5/629 X |

FOREIGN PATENT DOCUMENTS

| | | | |
|---|---|---|---|
| 466633 B | 3/1992 | Sweden . | |
| 1349543 | 4/1974 | United Kingdom | 5/628 |

*Primary Examiner*—Michael F. Trettel
*Attorney, Agent, or Firm*—Skinner and Associates

[57] ABSTRACT

The object of the invention is a padded and thermally insulated patient carrier/rescue stretcher, with an outer surface of fairly stiff plastic or similar with good sliding and wear properties. The stretcher has transverse grooves (4) and longitudinal grooves (2) acting as hinges permitting the stretcher and its sides to be folded. In the sides there are carrying openings (7) and tubular carrying handles (8). The sides are supported by tubes (6) of metal or reinforced plastic, supporting the grooves (5) along the edge, and pushed into the tubular carrying handles (8).

12 Claims, 5 Drawing Sheets

A-A

B-B

PATIENT CARRIER/RESCUE STRETCHER

BACKGROUND OF THE INVENTION

The object of the invention is a multi-purpose, light, collapsible, thermally insulated carrier for a patient or loads, equipped with edges with handles and especially intended for military, field, rescue and catastrophe use, which acts as a bed or portable stretcher, and which can be pulled or pushed like a sledge and which can float in water while supporting several persons Particularly in field conditions, improvised emergency means must be used for the primary transportation of wounded persons or the victims of accidents, because special equipment suitable for each situation is rarely available. In every emergency, whether in a city or in the country, in water, snow, on weak ice, in breaks in ice, in gullies, ruins, etc., rescue and transportation devices precisely adapted to the situation, weather and season of the year should be available. Until now, no generally applicable solution has existed.

A conventional stretcher can only be used for carrying. It cannot, for example, be pulled or pushed over snow, nor does it float in water. It generally does not have thermally insulated sides to protect the patient. Conventional stretchers are often equipped with feet, intended to protect the patient from contact with the ground, and dampness and loss of heat when placed on the ground. When lifting a patient with a fracture, for example, onto a stretcher of this kind, there is a danger of causing serious complications, such as fat embolism or damage to the spinal or other nerves. Using a conventional stretcher, the patient can only be transported by carrying from the handles, because the feet of the stretcher prevent pulling, and catch on even small obstacles, making it difficult to push the stretcher into vehicles, while snow and clay etc. adheres to them on the ground.

The carrying poles of conventional stretchers are generally always beneath the centre of gravity of the patient, causing lateral instability, especially when moving on sloping surfaces or on uneven ground. Uncertainty is increased by the lack of side and end walls, which can cause the patient to tend to slip and fall when the stretcher is tilted. Even if the patient is secured to the stretcher by lateral straps or belts, limbs can easily slip over the edges of the stretcher, where they are liable to damage from obstacles on the ground, ruins etc., especially during hurried transportation. The limbs of an unconscious patient in particular may be crushed against the side pole of a stretcher, possibly causing permanent damage to nerves or blood vessels.

However, stretchers are known, which present various solutions to the problems described above. Such solutions for solving part of the problem are described in the following publications: U.S. Pat. No. 3,348,245 shows the possible use of a hood, though by means of a different basic construction to the present invention. Various lateral and longitudinal grooves intended to facilitate collapsibility are shown in, for example, U.S. Pat. Nos. 5,189,746, 5,263,213 and 4,584,729. U.S. Pat. Nos. 5,274,864 and 4,473,912 show various kinds of carrying handles and openings. The use of a foot support is also known from, for example, Swedish Patent Publication 466633.

BRIEF SUMMARY OF THE INVENTION

The purpose of the present invention is to offer a patient carrier, which at its best, provides a base for carrying and treatment that is essentially safer, lighter and permits a greater variety of possible uses than previous patient carriers, for instance those referred to above, and which is impermeable by water, is easily movable, has a thermally insulated bottom and sides, and is equipped with a cushion supporting the neck and head, permitting the movement of a patient with face and even jaw injuries, and by means of which carrier a patient can be moved not only by carrying, but also by pulling, pushing and even by floating in water.

If the carrier/stretcher is manufactured from a material that absorbs X-rays only slightly or not at all, such as polyethylene, polypropylene or similar, and if all the necessary X-ray-positive components are situated near the edges of the stretcher, it is possible to carry the patient directly onto the X-ray examination table, without the patient having to be removed from the stretcher, as has been the case with previous stretcher solutions. A patient with multiple injuries can thus be moved, with no risk of additional traumas, together with the stretcher from the scene of the accident, by an ambulance, helicopter or similar, to a hospital bed and even to the operating table.

Using the carrier/stretcher described, a patient can be picked up even from places difficult of access (e.g. from weak ice or breaks in ice) or from places like stairways that are too narrow for conventional stretchers, in all the positions required in transport. The carrier/stretcher can be manufactured by heat welding lamination, the outer layer being a solid, stiff material with good sliding properties, the centre layer padding and thermally insulating cellular material such as polyethylene, and the inner layer being a surfacing of fabric, imitation leather or similar. The stretcher has longitudinal and lateral grooves, which are hot-pressed and act as hinges and as attachments for tubular or U-shaped carrying poles. The ends and sides have openings reinforced with metal rings for attaching a cushion, pulling and patient straps and if required a hood, a foot support for lifting the patient in a vertical position and for flotation pontoons.

Those and other beneficial aspects and advantages of this invention are achieved in the characteristic manner presented in the accompanying claims.

BRIEF DESCRIPTION OF THE SEVERAL VIEWS OF THE DRAWING

In the following, one embodiment of the invention and its assembly are described in detail by reference to the accompanying drawings, in which.

DETAILED DESCRIPTION

Figure 1:
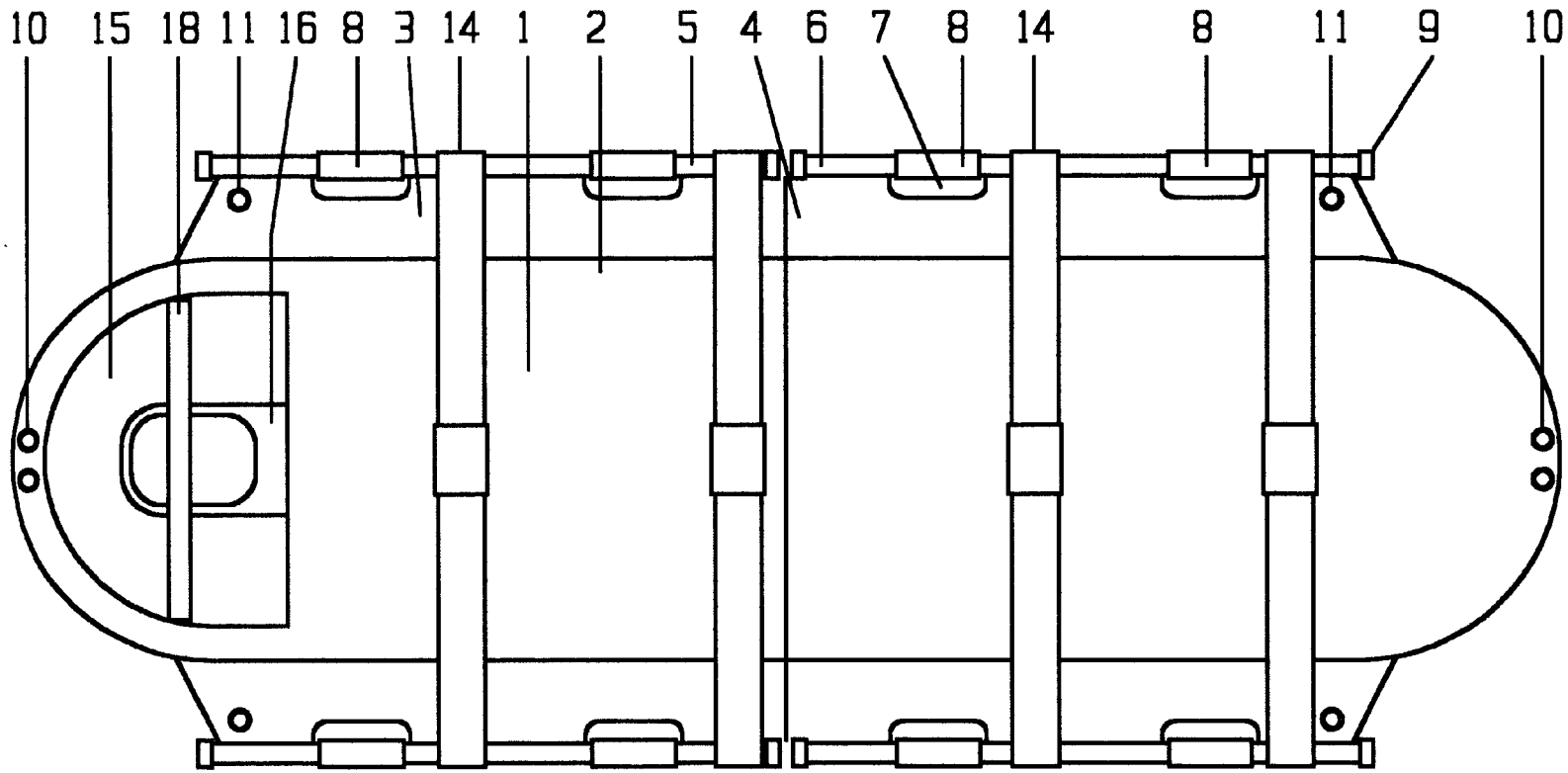
FIG. 1 shows the carrier/stretcher seen from above, with the sides spread.

FIG. 1 shows a top view of particularly a stretcher padded and thermally insulated with cellular plastic, the outer surface of which is reasonably stiff plastic with good sliding and wear characteristics, such as polyethylene, the inner surface being upholstered with fabric, imitation leather or similar. Its bottom 1 is rounded at the most suitable corners and is equipped with longitudinal, mainly hot-pressed grooves 2, acting as hinges for the sides 3. The stretcher has also one or more, particularly hot-pressed lateral hinges 4, allowing it to be folded up or folded into a sitting position, if required.

Thus there are longitudinal grooves 5 in the upper edge of each side, into which stiff metal or reinforced plastic tubes 6, split longitudinally along the lower surface and acting as carrying poles, are pushed, two on each side, so that they do not prevent the stretcher being folded. During assembly, the longitudinally split carrying poles are pushed into the grooves 5 in the sides, in such a way that a closed, tubular carrying handle 8 is placed at the four carrying openings 7 open at the top and permitting entry of a hand, the carrying pole 6 being pushed through it, whence the handle prevents the split tube from spreading, even under the heaviest load. Once the carrying poles 6 are in place, they are locked at the ends by cup-shaped plugs 9.

At each end of the stretcher, and at the ends of the sides, there are openings 10, 11, reinforced with metal, for attaching a pulling device or straps. The pulling strap 18 can be attached best by threading it through opening 11 in the side and openings 10 in the ends, then through opening 10 in the other side, so that when the stretcher is pulled, its end rises like the point of a ski to the degree of tilt permitted by the clamp 19. The sides have rectangular, metal-reinforced openings 12, through which there are loops 13 (e.g. FIG. 4), made from e.g. plastic packing bands, that are tightened to ensure that the carrying poles remain in place, and safety straps 14 for the patient or load.

An essential part of the stretcher is a U-shaped plastic or rubber bag 15, conforming to the shape of the end, attached by a Velcro closure, straps, cover locks etc. and most advantageously inflatable with air and possibly covered with fabric, in which there is an oval or U-shaped opening 16 the size of the centre of the face, into which a second, also inflatable cushion 17 fits, which can be turned beneath the larger bag either empty or inflated.

If only the larger U-shaped bag is inflated, it forms a head or neck support for a patient lying on his back or side. Immobilization can be further increased by securing the head with lateral headbands 18 attached by a Velcro closure. The thickness, softness and shape of the bag can be adjusted as required by the degree of inflation of the bags.

If the fully inflated small cushion 17 is turned under the larger cushion 15, it lifts the latter off the base, leaving large air gaps around the edges. This permits, for example the transportation of a prone patient with jaw and/or face injuries, the U-shaped cushion supporting the head from the brow, cheeks or forehead, keeping the respiratory tract unobstructed despite bleeding or vomiting and ensuring a supply of air from the aforementioned air openings.

If the U-shaped cushion is turned under the shoulders and shoulderblades of a supine patient, the neck bends sharply backwards, while the jaw simultaneously rises. This position permits endotracheal intubation (i.e. ensuring breathing by inserting a tube in the windpipe) during transportation.

Figure 2:
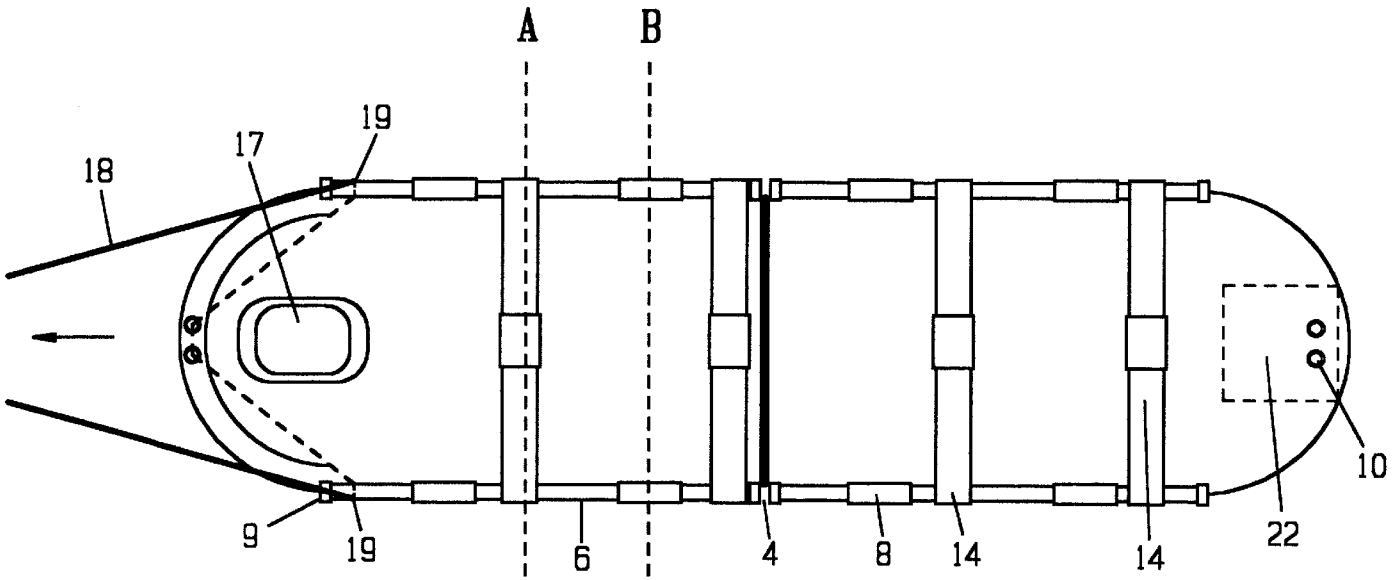
FIG. 2 shows the carrier /stretcher seen from above, with the sides raised.
Figure 3:
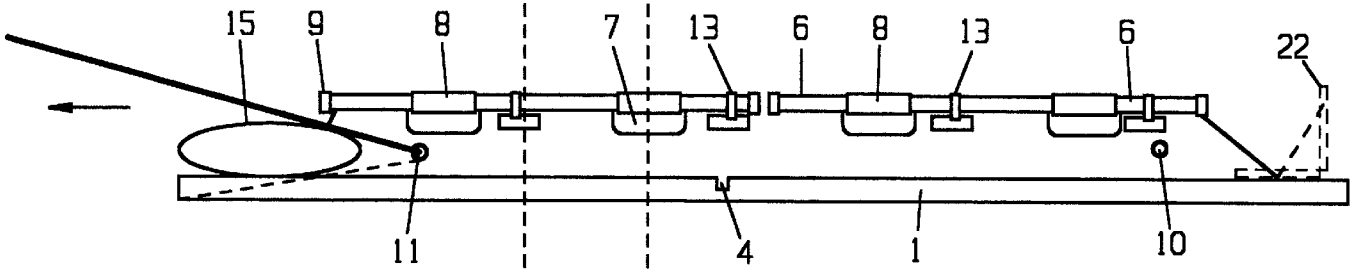
FIG. 3 shows the carrier/stretcher in a side view, with the sides raised.

FIG. 2 shows a rescue stretcher according to the invention as in FIG. 1, except that now the edges 3 are turned to an essentially vertical position, when the stretcher acquires an essentially U-shaped cross-section. FIG. 3 in turn shows a side view of the stretcher in the transportation position shown in FIG. 2. In all figures, the reference numbers refer to the same things.

Figure 4:
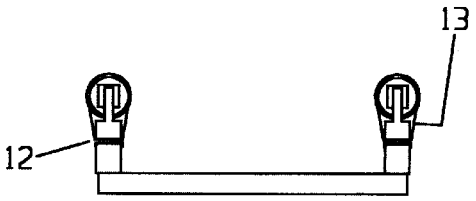
FIG. 4 shows a cross-section of the carrier/stretcher, along section line A—A of FIGS. 2 and 3.
Figure 5:
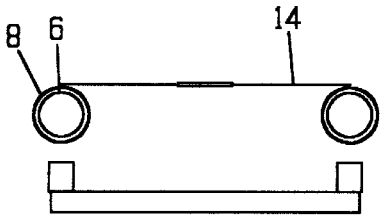
FIG. 5 shows a cross-section of the carrier/stretcher, along section line B—B of FIGS. 2 and 3, FIGS. 6 and 7 show the attachment of the carrying poles and handles as a cross-section at section line A—A.

FIGS. 4 and 5 show a stretcher according to the invention in cross-section along lines A—A and B—B in FIGS. 2 and 3. The figures show that the edges of a stretcher according to the invention have two types of opening. Opening 12 is reinforced and is used particularly to thread a securing strap or metal loop 13 or similar to secure the structure. Opening 7, on the other hand, forms a place for the carrying handles 8, when opening 7 ensures sufficient hand space, even if the bearer wears gloves.

Figure 6:
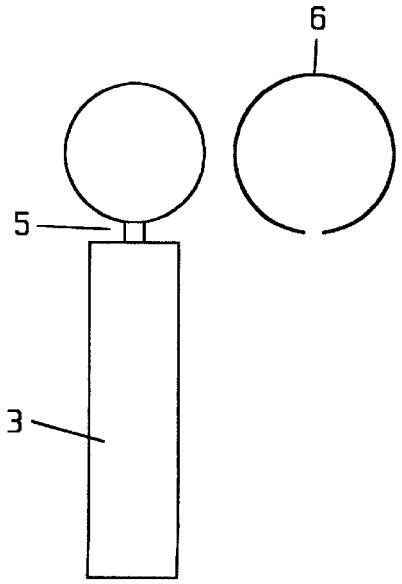
Figure 7:
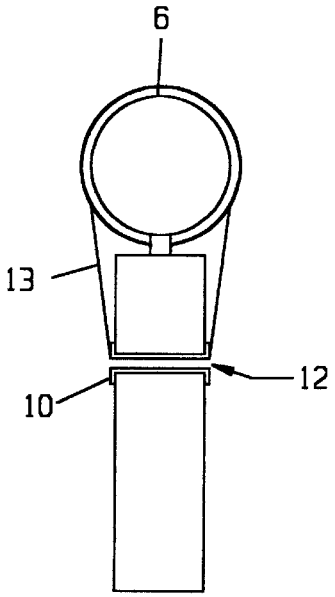
Figure 8:
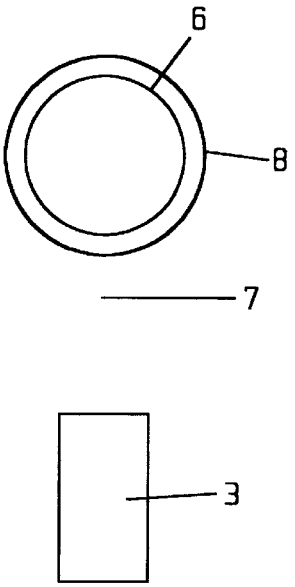
FIG. 8 shows the attachment of the carrying poles and handles at section line B—B.

FIGS. 6, 7 and 8 show the situation in FIGS. 4 and 5 on a larger scale. In FIG. 6, the carrying handle 6 is still separate, in FIG. 7 it has been placed ready for use and loop 13 has also been attached. FIG. 8 shows a situation corresponding to that in FIG. 5.

Figure 11:
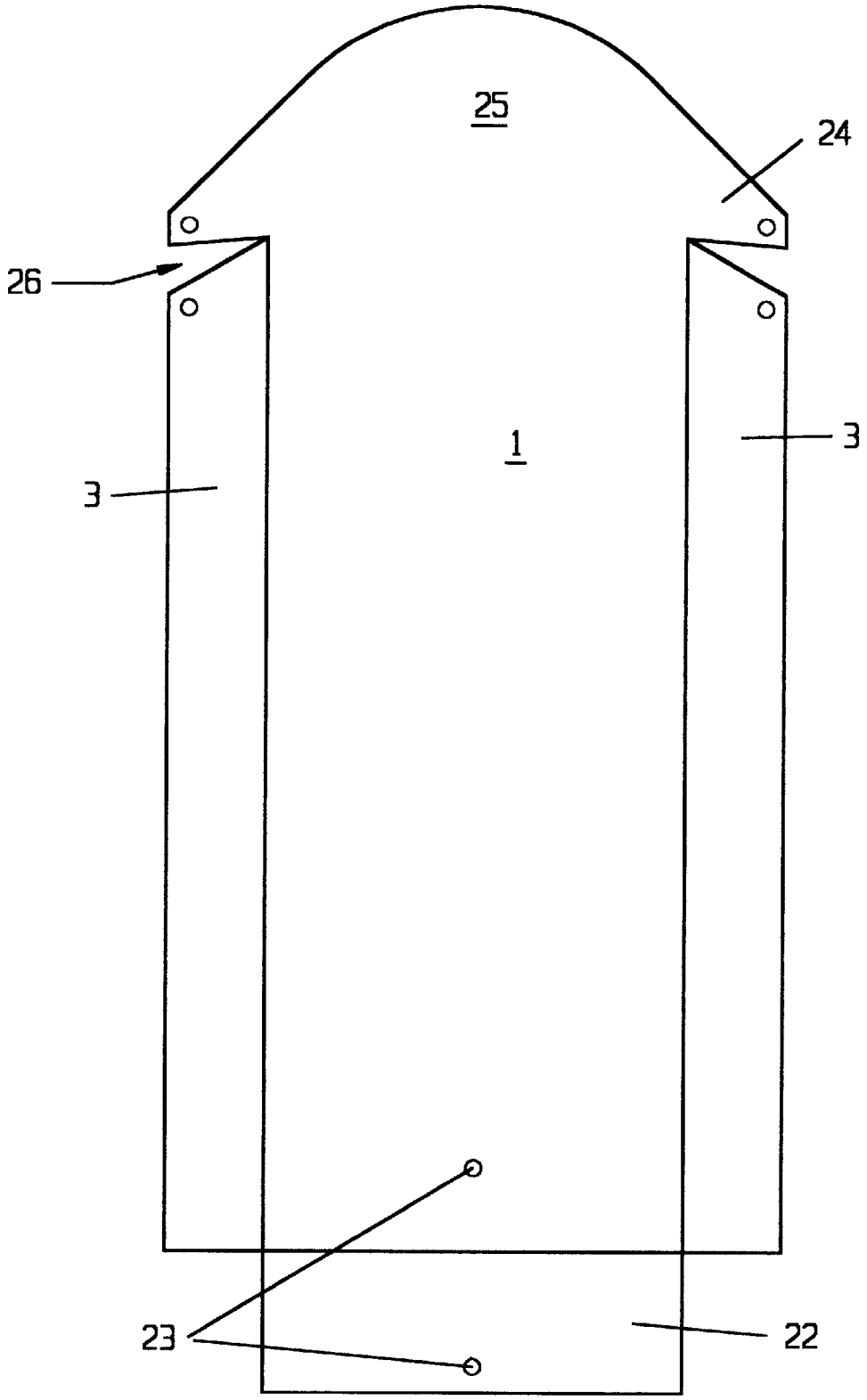
FIG. 11 shows various embodiments of the front and rear sections of the invention.

A hinged foot support 22, permitting the patient to be moved in a vertical position and lowered, for example, feet first through a window during a fire in an apartment block, can be attached to the metal-reinforced openings 10, 11 at the foot end of the stretcher. However, as FIG. 11 shows, an extremely convenient foot support can be made from the centre section of the stretcher by folding the centre section extension to the vertical position and securing it to the rear lateral strap 14 (not show in FIG. 11) by straps, for example. If it is wished to fold a stretcher according to the invention into the transport position, the central section extension can be folded inwards to lie straight along the bottom section. The best arrangement it to hold the extension in this position with a Velcro closure or push-stud fastening 23.

Figure 9:
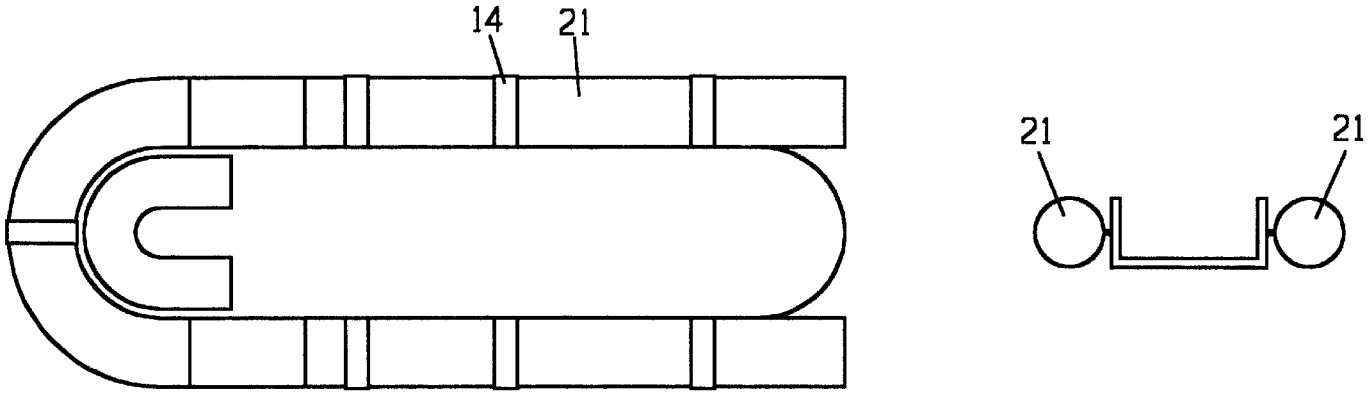
FIG. 9 shows the location of the air-filled flotation pontoons to be attached to the stretcher.

A plastic or rubber flotation pontoon 21 fitting the sides, inflated or filled with cellular plastic, can be attached to the stretcher by straps 14 or loops 13 for rescue operations in water, on weak ice or in breaks in ice. FIG. 9 shows this alternative. Any other suitable attachment can also be used.

Figure 10:
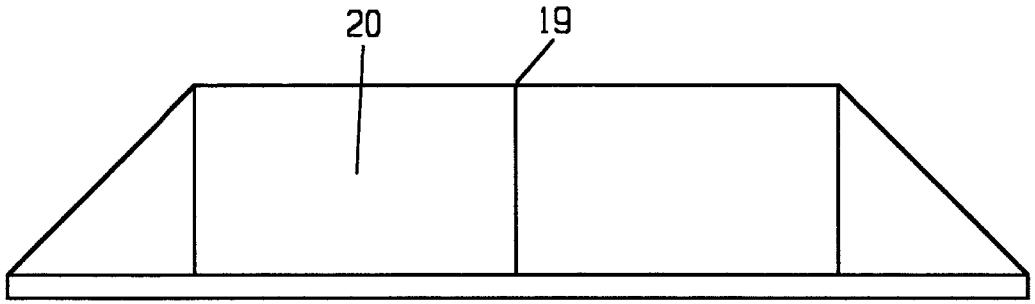
FIG. 10 shows a side view and cross-section of the hood and support bar that can be attached to the stretcher.

FIG. 10 shows how a tent-like hood 20, providing protection from rain , spray and wind, can be attached to the stretcher by curved bars pushed into the tube-like grooves in the sides.

FIG. 11 shows an advantageous way to form the front of the stretcher into a shape like the prow of a sledge that also effectively keeps snow out of the stretcher when it is pulled through snow. Here the front of the stretcher has an obvious protrusion 25, formed from the same part as the central section 1 of the stretcher. Protruding part 25 has tabs 24 with reinforced holes or other means for attaching the tabs to the side edges 3 of the stretcher.

In practice, this takes place as follows. The edges 3 of the stretcher are raised to an essentially vertical position. Tab 24 is turned to lie along the outer side of edge 3, when it can be attached to edge 3. The angle of the front part 25 then changes due to a certain tension so that it rises to form a suitably inclined prow to the stretcher. Placing the tab 24 at the outer side of the edge 3 completely closes the gap 26 between the tab and the edge. The attachment from both sides forms a tight sledge-like construction.

As the description above shows, a patient carrier/rescue stretcher according to the present invention has essentially more comprehensive characteristics than previous stretchers and other carriers, both technically and in its range of use. A patient carrier/rescue stretcher according to the invention is essentially lighter than previous stretcher solutions. The embodiment of the stretcher described here, including cushions and patient securing straps, weighs only about 3.0 kg. 2–8 bearers can carry the stretcher by the ends and sides. If required, the stretcher can also be pulled as a very easily sliding, thermally insulated sledge. It will float in water carrying 2–3 persons and can provide flotation support, in place of lifebuoys, for up to 10 persons. Easily attached, light, collapsible and inflatable pontoons can multiply its buoyancy many times.

A stretcher according to the invention permits a patient to be transported with head and neck support in all positions needed in transport and first aid: prone and supine, on his side or sitting up. A patient who has face and jaw injuries, or who is vomiting, can be transported face down, the U-shaped cushion ensuring a supply of air and preventing aspiration. The cushion also permits intratracheal intubation in the field and during transportation.

The stretcher according to the invention will also fit inside a backpack that can be carried by one person, and which also generally facilitates the handling and storage of the stretcher.

A stretcher according to the invention is also relatively simple and cheap to manufacture. If necessary, the multi-layer plastic frame can be made as one piece, by hot lamination. The manufacture of the other components too requires no expensive special tools or procedures.

The invention is not restricted to the embodiment described here, but may be adapted within the scope of the accompanying claims.

What is claimed is:

1. A padded patient carrier/rescue stretcher, with an outer surface of fairly stiff plastic or similar with good sliding and wear characteristics and an inner surface upholstered with fabric, imitation leather or another suitable surface, and with longitudinal grooves (2) that define a bottom (1) and hinged sides (3), carrying handles (8), and a transverse groove (4) permitting folding, characterized in that the carrying handles (8) are tubular and placed in relation to the longitudinal grooves (2) at carrying openings (7) formed in an outer edge of the hinged sides (3), that the sides (3) are supported by stiff tubes (6) or metal or reinforced plastic split along a lower surface of the tubes (6), which support grooves (5) along the edge of the sides (3) and act as carrying poles, and that the tubes (6) penetrate through the tubular carrying handles (8).

2. A padded patient carrier/rescue stretcher according to claim 1, characterized in that it has a U-shaped plastic or rubber bag (15), which is attached to the stretcher and is inflatable and is adapted for supporting a patient's head and neck, with an opening (16) into which another inflatable cushion (17) fits.

3. A padded patient carrier/rescue stretcher according to claim 1, characterized in that a pulling strap (18) is attached to a front end of the stretcher through reinforced openings (10, 11), which can be clamped in such a way that when the stretcher is pulled like a sledge, the front end bends upwards to form a shape of a ski point.

4. A padded patient carrier/rescue stretcher according to claim 1, characterized in that the sides (3) have openings (12) through which ring-like bands extend to lock the carrying poles (6) and securing straps (14) for a patient or load.

5. A padded patient carrier/rescue stretcher according to claim 1, characterized in that it has a hinged foot support (22).

6. A padded patient carrier/rescue stretcher according to claim 5, characterized in that the hinged foot support (22) is a separate foot support attached to the stretcher.

7. A padded patient carrier/rescue stretcher according to claim 5, characterized in that the hinged foot support (22) is formed by an extension from the bottom of the stretcher.

8. A padded patient carrier/rescue stretcher according to claim 1, characterized in that it has a flotation pontoon (21) filled with air or cellular plastic.

9. A padded patient carrier/rescue stretcher according to claim 1, characterized in that it has a cloth or plastic hood (20) equipped with flexible curved bars (19).

10. A padded patient carrier/rescue stretcher according to claim 1, characterized in that the sides (3) are thermally insulated.

11. A padded patient carrier/rescue stretcher according to claim 1, characterized in that in front of the stretcher there is a protrusion (25), with tabs (24) that can be secured to the hinged sides (3) which have been pivoted into an essentially vertical position, and tensioned so that the protrusion (25) rises like the prow of a sledge.

12. A padded patient carrier/rescue stretcher according to claim 1, characterized in that the stretcher can be folded so that it can be packed into a backpack.

* * * * *